United States Patent [19]

King et al.

[11] Patent Number: 5,033,676

[45] Date of Patent: Jul. 23, 1991

[54] SELF-CLEANING SPRAY NOZZLE

[75] Inventors: William J. King, Orange; Robert J. Voyle, Buena Park, both of Calif.

[73] Assignee: Pure-Chem Products Company, Inc., Stanton, Calif.

[21] Appl. No.: 387,495

[22] Filed: Jul. 28, 1989

[51] Int. Cl.[5] ..... B05B 15/02

[52] U.S. Cl. ..... 239/107; 239/459

[58] Field of Search ..... 239/75, 106, 108, 109, 239/452, 456, 443, 597, 397.5, 580, 107

[56] References Cited

U.S. PATENT DOCUMENTS

| | | | |
|---|---|---|---|
| 502,742 | 8/1893 | McGowen | 239/107 X |
| 969,287 | 9/1910 | Kinealy | 230/107 X |
| 1,195,080 | 8/1916 | Pettit | 239/107 |
| 1,505,331 | 8/1924 | Gold | 239/107 |
| 1,564,963 | 12/1925 | Kirgan | 239/107 |
| 2,986,342 | 5/1961 | Dahl | 239/580 X |
| 3,067,809 | 12/1962 | Dresing | 239/75 X |
| 3,273,803 | 9/1966 | Crowley | 239/107 X |
| 3,412,936 | 11/1968 | Boucher et al. | 239/107 |
| 4,511,083 | 4/1985 | Muller-Girard | 239/75 X |

FOREIGN PATENT DOCUMENTS

| | | | |
|---|---|---|---|
| 3213999 | 10/1983 | Fed. Rep. of Germany | 239/75 |
| 1513736 | 1/1976 | United Kingdom | 239/107 |

*Primary Examiner*—Andres Kashnikow
*Assistant Examiner*—Kevin Weldon
*Attorney, Agent, or Firm*—Willie Krawitz

[57] ABSTRACT

A spray nozzle comprises a hollow body having an inlet, an outlet and a fluid flow passage therebetween. The body contains a pressure-responsive or a pressure responsive and temperature responsive valving element that increases the effective area of the outlet in response to an increase in pressure or an increase in pressure and/or temperature. In a preferred embodiment, the outlet includes a restricted orifice and an unrestricted orifice, and the valving element is movable within the body between a first position in which the restricted orifice is open and the unrestricted orifice is closed, and a second position in which the unrestricted orifice is open. The valving element is biased in the first position by a spring which applies a selectable biasing force that defines a threshold pressure, so that the valving element is moved to the second position by a dynamic pressure of the fluid flowing through the flow passage that is greater than the threshold pressure. In an alternative embodiment, the outlet is provided with a resilient occluder having an orifice that increases in area as the occluder is flexed axially in the downstream direction in response to an increase in the dynamic pressure of the fluid flow.

10 Claims, 2 Drawing Sheets

SELF-CLEANING SPRAY NOZZLE

BACKGROUND OF THE INVENTION

1. Field of the Invention

This invention relates generally to the field of self-cleaning nozzles and the like, that are used for providing a directional spray or stream of a pressurized fluid from a conduit. More particularly, it relates to a nozzle that is selectively operable in a first mode to direct a spray or stream of fluid from its outlet, and in a second mode to flush the nozzle with a purging flow of the fluid.

2. Discussion of the Prior Art

Spray nozzles have long been used in the food processing and packaging industry to spray lubricating and cleaning solutions onto conveyers for bottles, cans and other packages. A conveyer lubricating system that uses a spray nozzle is disclosed in U.S. Pat. No. 4,262,776 to Wilson et al. The nozzles in such systems are, however, prone to clogging, due to the nature of the lubricants used in such systems, which typically contain soapy detergents, which create build-ups of deposits. The situation is aggravated where hard water is used to dilute the lubricant, because of the build-up of mineral deposits, and where the conveyer is run through refrigerated areas, where the lubricant tends to degrade and thicken. Other sources of clogging are particulate or fibrous debris in the system, and microbiological growth in the nozzle.

Typically, conveyer lubricating systems use flow rates through the nozzles of about one to five gallons per hour. Typical nozzle orifice diameters are in the range of about 0.01 to 0.10 inches, operating at pressures ranging from about 10 to 60 psi. Such low flow rates and relatively low pressures exacerbate the problem of nozzle clogging.

Consequently, frequent manual cleaning of the spray nozzles is required. This leads to costly down-time for the conveyer, or attempts to clean the nozzles while the conveyer is moving, which present a danger of injury to the workers.

Similar problems are present in irrigation systems that use low flow-rate spray nozzles. Such nozzles frequently become clogged with algae, or with mineral deposits from "white" water.

Ideally, the solution to the clogging problem would be the use of self-cleaning nozzles. Such nozzles are known in the art, exemplified by U.S. Pat. No. 3,685,735 to Foster. Nozzles the type disclosed in the Foster patent provide a spraying action in their normal mode of operation. When the line pressure drops below a certain level, however, a spring-biased piston is retracted to open the outlet orifice more widely, thereby allowing a purging flow through the orifice to remove debris therefrom. The need to maintain a relatively high dynamic line pressure to operate this type of nozzle in its normal, spraying mode, however, is contrary to the need for low pressure spraying in conveyer lubricating applications, making this type of nozzle unsuitable for such applications.

There exist nozzles that provide a self-cleaning action in response to a static pressure increase within the nozzle structure resulting from a reduction in flow through the nozzle, as from clogging. See, for example, U.S. Pat. No. 3,203,629 to Goddard; and U.S. Pat. No. 3,430,643 to Heiland. These nozzles do not, however, permit a "purge" mode to be selected by increasing the dynamic ("line") pressure of the flow to the nozzle above a predefined threshold pressure.

There has thus been a long-felt, but as yet unsatisfied need in the food and beverage industry for a spray nozzle that provides a directional spray at low flow rates and low pressures, and that can be selectively operated in a purge mode by exceeding a preselected threshold line pressure to unclog the nozzle.

SUMMARY OF THE INVENTION

Broadly, the present invention is a self-cleaning spray nozzle, comprising a hollow body defining a flow passage with an inlet and an outlet, and valving means within the body for increasing the effective area of the outlet in response to the dynamic pressure of a fluid flowing through the passage exceeding a preselected threshold pressure.

In a preferred embodiment, the outlet comprises a restricted spray orifice, and a larger ("unrestricted") purge orifice. A valve or variable orifice element is disposed within the body for axial movement between a first position in which the spray orifice is open and the purge orifice is closed, and a second position in which the purge orifice is open. Biasing means, such as a spring, biases the valve element so as to maintain it in the first position when the dynamic pressure of the fluid flowing through the passage is less than the threshold pressure. When the dynamic pressure of the fluid flow exceeds the threshold pressure, the force applied by the biasing means against the valve element is overcome, and the valve element is moved to its second position to open the purge orifice.

In the preferred embodiment, the valve element is a poppet valve having a stem terminating in a head. With the valve element in the first position, the valve head is seated against an annular valve seat with a central aperture defining the purge orifice, and a notch or gap in the valve seat defining the spray orifice. The notch or gap is disposed so as to remain open when the valve head is seated against the valve seat. A coil spring surrounds the valve stem and biases the valve head to close against the seat. The threshold pressure is proportional to the spring constant. There is advantageously provided some means to adjust the spring constant, such as a fitting threaded onto the valve stem. The fitting engages one end of the spring so as put the spring under a compression that can be adjusted by changing the position of the fitting on the valve stem.

The preferred embodiment may be modified by making the valve stem hollow, and installing in the hollow stem a rod of material having a higher coefficient of thermal expansion than the material forming the valve element, one end of the rod being fixed to the nozzle body. With this structure, an increase in temperature of the fluid flowing through the passage causes the rod to expand axially at a greater rate than the axial expansion of the valve element, resulting in the valve head being lifted from its seat when a preselected fluid temperature is reached, even if the pressure is unchanged.

An alternative embodiment features a hollow body defining a flow passage between an inlet and an outlet, with a resilient occluder in the outlet. The occluder has an orifice with a first effective area when the occluder is at normal operating fluid pressures. When the dynamic pressure of the fluid flowing through the passage increases, the occluder is flexed axially in the downstream direction. The flexing of the occluder causes its orifice to increase in area to provide a purging of the nozzle.

As will be appreciated more fully from the detailed description that follows, the present invention offers a number of significant advantages. First, it offers a self-cleaning nozzle that is operable in a normal, spraying mode at low line pressures and flow rates, making the nozzle suitable for use in conveyer spraying systems. In addition, the nozzle can be selectively operated in its purge mode by increasing the line pressure above a predetermined threshold, allowing the operator to control the timing of the purging operation. This feature also allows a conveyer spraying system, for example, to be operated in a low pressure spraying mode for lubricating the conveyer, and in a high pressure cleaning mode for washing the conveyer with a detergent, while also removing debris and deposits from the nozzles. Furthermore, the present invention allows the threshold pressure which determines the onset of the purge mode to be controllably varied, giving the operator an added degree of control to accommodate a wide variety of situations and applications.

These advantages are provided in a nozzle that can be easily and economically manufactured. It can be readily installed in existing conveyer spraying systems, and it requires little or no maintenance once installed.

DETAILED DESCRIPTION OF THE INVENTION

Figure 1:
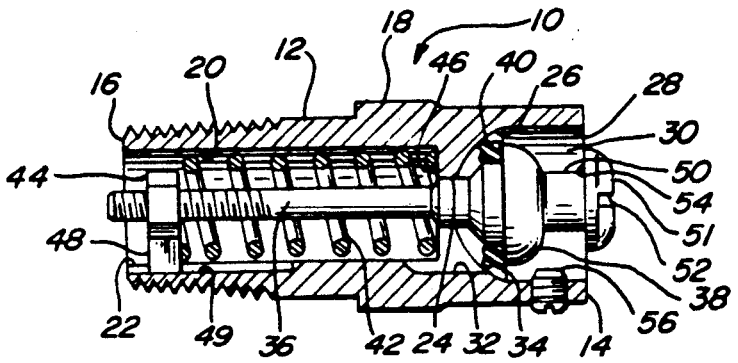
FIG. 1 is an axial cross-sectional view of a self-cleaning spray nozzle in accordance with a preferred embodiment of the invention.
Figure 2:
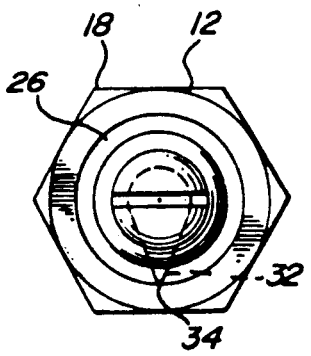
FIG. 2 is a front elevational view taken along line 2—2 of FIG. 1.
Figure 3:
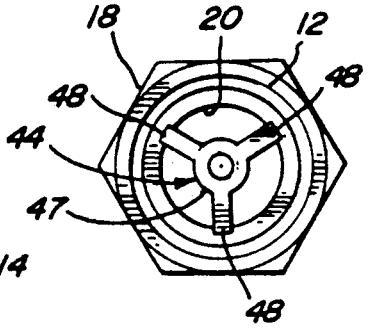
FIG. 3 is a rear elevational view taken along line 3—3 of FIG. 1.

Referring first to FIGS. 1, 2, and 3, a self-cleaning spray nozzle 10, in accordance with a preferred embodiment of the invention, is shown. The nozzle 10 includes a hollow body 12, with a front, or outlet end 14, and a rear, or inlet end 16. The inlet end is preferably externally threaded, so that it can be coupled to an internally threaded fitting (not shown) on a fluid conduit (not shown). The body 12 preferably has a hexagonal portion 18, to facilitate the installation and removal of the nozzle by means of a wrench or the like.

The interior of the body 12 defines a fluid flow passage 20 between an inlet 22 in the inlet end 16, and the outlet end 14. An annular valve seat 24 is disposed around the passage 20 just upstream of the outlet end 14. The valve seat 24 has a curved, concave, downstream surface 26 that is contiguous with a cylindrical interior body wall surface 28 to define an unrestricted outlet orifice 30. A radially-extending, substantially wedge-shaped notch or gap 32 is formed in the valve seat downstream surface 26 to define a restricted outlet orifice 34.

A poppet valve, comprising a valve stem 36 terminating in a poppet head 38, is disposed longitudinally within the body 12 for axial translation therein. The poppet head 38 seats against the valve seat downstream surface 26, with a peripheral O-ring 40, carried by the poppet head 38, providing a seal between the poppet head 38 and the surface 26. The O-ring 40 is preferably a four-sided or "quad"-type O-ring, although a standard O-ring of circular cross-section or a sealing washer can be used.

The valve stem 36 extends from the poppet head 38 upstream through the valve seat 24 toward the inlet 22. Concentrically surrounding the valve stem 36, upstream of the valve seat 24, is a coil spring 42. An internally threaded fitting 44 is threaded onto the upstream end of the valve stem 36, a substantial portion of which is externally threaded to allow a substantial amount of adjustment of the axial position of the fitting 44 on the valve stem 36. The coil spring 42 is placed under compression between the downstream side of the fitting 44 and a fixed spring seat 46 formed by the upstream side of the valve seat 24. The fitting 44 thus provides an axially-movable spring seat that allows the compression of the spring 42 to be adjusted, while also functioning as a retaining nut for retaining the poppet valve 36, 38 within the body 12. The fitting 44 is of an open structure to allow the passage of fluid. To this end, as shown in FIG. 3, the fitting 44 comprises an internally-threaded center section 47 from which radiate a plurality of spokes 48 that support the spring 42. The fitting 44 may be restrained from rotation by having the spokes 48 seated in longitudinal grooves 49 in the interior wall of the body 12, as shown in the drawings, or the spring 42 may be provided with an extension (not shown) that extends between the spokes. Alternatively, spring tension may restrain the nut from turning by frictional contact.

Extending outwardly from the downstream surface of the poppet head 38 is a central cylindrical hub 50, terminating in a screw head 51 having a screwdriver slot 52 on its outer surface. The diameter of the screw head 51 is larger than that of the hub 50, so that a shoulder 54 is formed on the underside of the screw head 51.

A deflector screw 56 is advantageously threaded radially into the body 12 so as to extend into the unrestricted outlet orifice 32 directly downstream from the restricted outlet orifice 34 and from the poppet head 38. The valve element 36, 38 and the valve seat 34 and accompanying structure described above is sometimes referred to hereinafter as "a variable orifice means".

In operation, the nozzle 10 is installed in a conveyer spraying system or an irrigation system by threading the inlet end 14 into an appropriate fitting that communicates with the conduits carrying a pressurized flow of fluid, so that a flow of the fluid is directed into the flow passage 20 from the inlet 22. The coil spring 42 biases the poppet head 38 against the annular valve seat surface 26 with a force that is proportional to the spring constant of the spring 42, which, in turn, is proportional to the degree of compression of the spring between the fitting 44 and the spring seat 46. As long as the dynamic ("line") pressure communicated to the upstream side of the poppet head 38 is less than the biasing force of the spring 42, the poppet head remains seated against the seating surface 26, thereby closing the unrestricted outlet orifice 32. The restricted orifice 34, defined by the radial gap 28 in the seating surface 26, remains open, however, to provide a spray outlet for the fluid.

When the line pressure exceeds the biasing force of the spring 42, the pressure of the fluid flowing through the passage 20 against the upstream side of the poppet head 38 causes the poppet head to move away from the seating surface 26, thereby opening the unrestricted outlet orifice 32. With the unrestricted orifice 32 open, the effective outlet area of the nozzle is drastically increased, thereby permitting a purging flow past the poppet head 38 and through both the restricted spray orifice 34 and the unrestricted purge orifice 32.

Thus, the nozzle operates in the spraying mode, with the fluid emerging only from the restricted spray orifice 34, as long as the line pressure is below the threshold pressure defined by the biasing force applied by the spring 42. When the threshold pressure is exceeded, the nozzle operates in its purge mode, with the fluid emerging from both the restricted orifice 34 and the unrestricted orifice 32.

The threshold pressure, being proportional to the spring constant of the spring 42, and thus proportional to its degree of compression, can be selectively adjusted by changing the compression of the spring. This is accomplished by changing the axial position of the threaded fitting 44 on the valve stem 36. To this end, the screw head 51, with its screwdriver slot 52, can be employed to screw the valve stem 36 into and out of the fitting 44, thereby respectively increasing and decreasing the compression of the spring 42. It will be appreciated that this adjustment can be performed without removing or disassembling the nozzle. Indeed, the adjustment can be made while the spraying or irrigation system is in operation.

It may be necessary, on occasion, to move the valve element 36, 38 into its purge position manually, due to, for example, a temporary loss of the ability to pressurize the fluid above the threshold pressure. To this end, an instrument or tool, such as a screwdriver or a knife, can be wedged under the shoulder 54 of the screw head 51 to pry the poppet head 38 away from the seating surface 26 without dismantling the nozzle or hindering normal plant operation.

The restricted spraying orifice 34 is configured to deliver fluid in a directed stream. The deflector screw 56 can be adjusted to intrude into the path of the stream to varying degrees, causing the stream to disperse into a fan-shaped spray.

In a specific example of a nozzle constructed in accordance with a preferred embodiment of the invention, the threshold pressure was set, by means of the spring 42, to be 50 psi. Flow was maintained through the restricted outlet orifice only at pressures below 50 psi, with flow rates ranging from 0.014 gallons per minute at 10 psi to 0.048 gallons per minute at 40 psi. When 50 psi of line pressure was reached, the flow rate through the nozzle increased markedly to 0.656 gallons per minute, as a result of the unrestricted orifice popping open. By adjusting the compression of the spring 42, as previously, described, the threshold pressure could be varied between 30 and 70 psi.

Thus, purging of the nozzle can be selectively performed whenever necessary or desirable by simply increasing the line pressure to a point above the preselected threshold pressure. In addition, the present invention employed in a conveyer spraying system allows the spraying system to be selectively operated at a first pressure, below the threshold pressure, for spraying a lubricant onto the conveyer, and at a second pressure, greater than the threshold pressure, for cleaning the conveyer with a high flow-rate stream of a cleansing solution.

Figure 6:
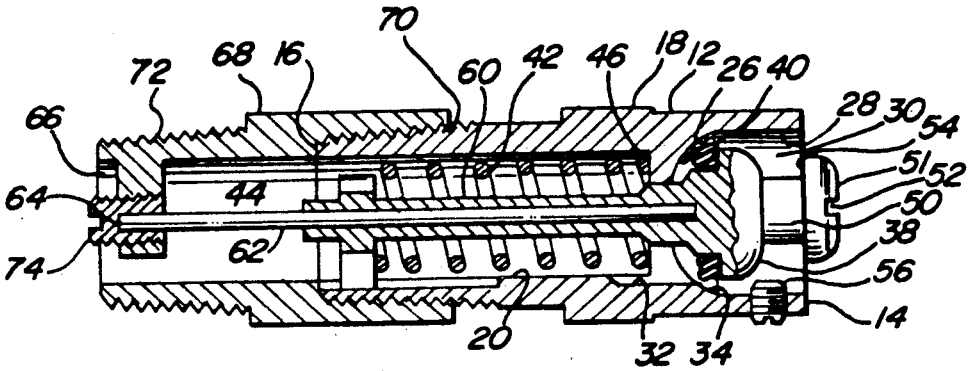
FIG. 6 is an axial cross-sectional view of another embodiment of the invention, in the normal, spraying mode of the nozzle.
Figure 7:
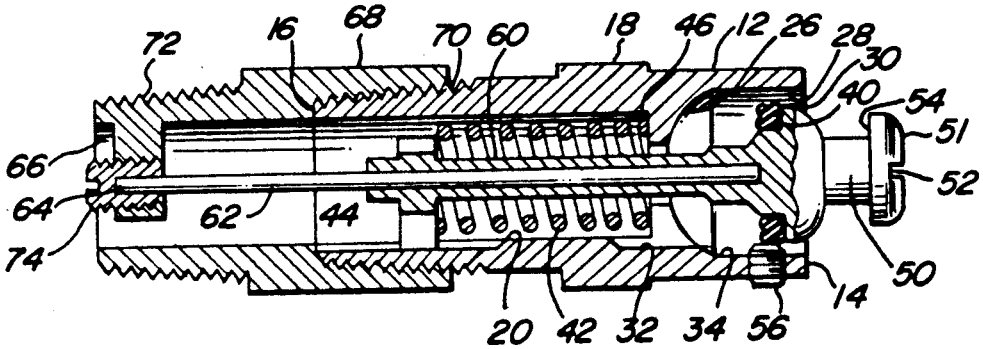
FIG. 7 is a view similar to that of FIG. 6, but showing the nozzle in its purge mode.

A modification of the preferred embodiment of the invention is shown in FIGS. 6 and 7. In this modification, a hollow valve stem 60 is used, with an expansion rod 62 slidably inserted into the interior of the valve stem. The materials of the valve stem 60 and the expansion rod 62 are selected so that the expansion rod has a coefficient of thermal expansion that is significantly greater than that of the valve stem. For example, the expansion rod can be made of 66 Series nylon, while the valve stem can be made of 304 stainless steel.

The expansion rod 62 extends in an upstream direction beyond the end of the valve stem 60, terminating in a fixed end 64 that is supported by a radial finger 66 at the inlet end of an adapter 68. The adapter 68 has an internally-threaded outlet end 70 for removable coupling to the inlet end 14 of the nozzle. The inlet end of the adapter 68 is carries external threads 72 for removable coupling to the spraying or irrigation system fitting. The interior of the adapter 68 is hollow, so as to provide fluid communication with the inlet 22 of the nozzle. The finger 66 preferably is provided with a hollow-bodied screw 74, the interior of which holds the fixed end 64 of the expansion rod 62.

The nozzle of FIGS. 6 and 7 can be operated to purge in response to an increase in line pressure, exactly as described above with respect to the nozzle of FIGS. 1, 2, and 3. In addition, the nozzle can be operated to switch to its purge mode in response to an increase in the temperature of the fluid passing through the body. Specifically, increasing the temperature of the fluid causes the rod 62 to expand longitudinally faster than the valve stem 60, because of the differing coefficients of thermal expansion. Above a preselected threshold temperature, the rod 62 will have expanded sufficiently to lift the valve head 38 away from the seating surface 26, overcoming the biasing force of the spring 42. The threshold temperature can be varied by adjusting the hollow-bodied screw 74, which moves the rod 62 toward or away from the valve head 38.

Figure 4:
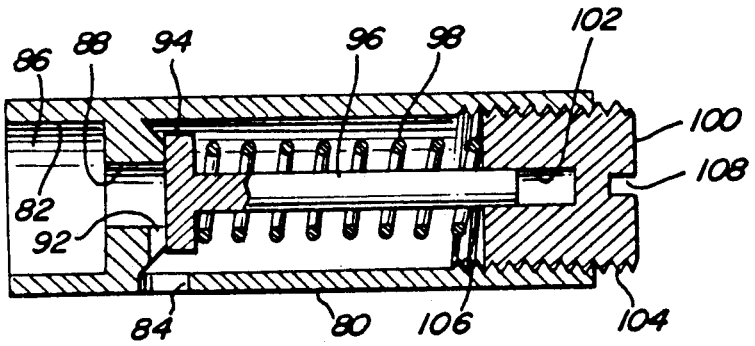
FIG. 4 is an axial cross-sectional view of an alternative form for the preferred embodiment of the invention.

FIG. 4 illustrates an alternative form for the preferred embodiment of the nozzle. In this form, the nozzle has a hollow, tubular body 80, with an inlet 82, an outlet port 84, and a flow passage 86 therebetween. The flow passage passes through an annular valve seat 88, which defines an unrestricted outlet orifice. The valve seat 88 has a radial notch or gap 92, which defines a restricted outlet orifice.

A poppet valve, comprising a poppet head 94 and a valve stem 96, is disposed for axial movement within the body 80, with the poppet head 94 being biased against the downstream side of the valve seat 88 by a coil spring 98 disposed around the valve stem 96. The spring 98 is placed under compression against the downstream side of the poppet head 94 by an axially-adjustable spring seating member 100, having a central recess 102 that receives the end of the valve stem 96. The seating member 100 has external threads 104 that mate with internal threads 106 in the interior surface of the body. The threaded engagement between the seating member 100 and the body 80 allows the seating member to be moved axially within the body 80 to vary the compression of the spring 98. This movement is facilitated by a slot 108, on the outer surface of the seating member that extends from the body 80. The slot 108 can accommodate a screwdriver or the like.

The operation of the nozzle of FIG. 4 is similar to the operation described above with respect to the nozzle of FIGS. 1, 2, and 3. Specifically, The poppet head 94 is normally biased against the valve seat 88 by the spring 98, closing the unrestricted orifice, but keeping the restricted orifice defined by the radial notch 92 open. When the line pressure experienced at the inlet 82 exceeds the biasing force applied by the spring 98, the poppet head 94 is lifted from the valve seat 88 to open the unrestricted orifice. Thus, the nozzle transitions from its spray mode to its purge mode in response to a line pressure that exceeds a threshold pressure defined by the biasing force of the spring 98. This threshold pressure can be adjusted by changing the compression of the spring through the adjustment of the axial position of the spring seating member 100, as previously described.

The restricted orifice provided by the notch 92 has a much smaller effective area than does the outlet port 84, and the notch 92 is configured to deliver the fluid flowing through it in a directed stream. The opening of the unrestricted orifice substantially increases the effective area of the outlet, to effectuate an efficient purging action.

Figure 5:
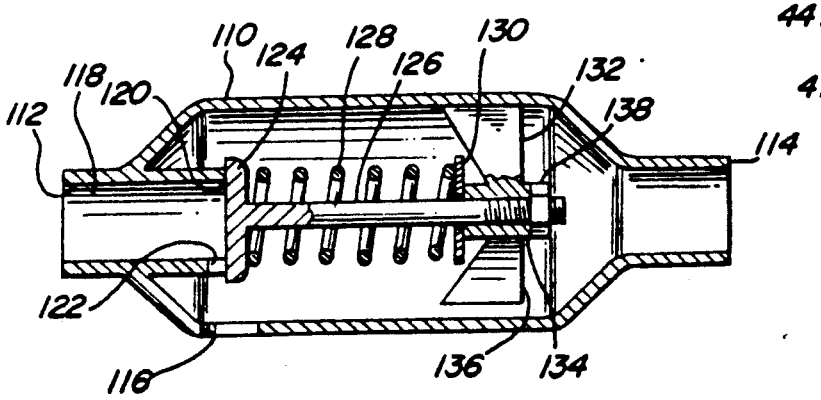
FIG. 5 is an axial cross-sectional view of another alternative form for the preferred embodiment of the invention.

Another alternative form of the preferred embodiment of the nozzle is illustrated in FIG. 5 and is very similar to that of FIG. 4. In the form shown in FIG. 5, the nozzle has a hollow, tubular body 110 having a first end with an inlet 112 and an open second end that provides a secondary outlet port 114, as will be discussed below. A primary outlet port 116 is provided in the side of the body, near the inlet end. A flow passage 118 is provided between the inlet 112 and the primary outlet port 116, with the flow passage passing through an annular valve seat 120 that defines an unrestricted outlet orifice. The valve seat 120 has a radial gap or notch 122 that defines a restricted orifice. A poppet valve, comprising a poppet head 124 and a valve stem 126, is disposed for axial movement within the body 110, with the poppet head being biased against the valve seat 120 by a coil spring 128 disposed around the valve stem 126. Compression is applied to the spring 128 by a compression plate 130 that is carried on compression plate carrier 132. The compression plate carrier 132 comprises a cylindrical member 134 with an axial bore that receives the end of the valve stem 126. A plurality of vanes 136 extend radially from the cylindrical member 134 to the interior wall of the nozzle body 110, and are secured thereto. The valve stem 126 slides within the carrier 132 and is located by a nut 138, which is threaded onto the externally-threaded end of the valve stem. This nozzle is designed to be molded from a plastic such as PVC. The compression of the spring can be changed by changing the spring at the time of manufacture.

The nozzle of FIG. 5 is functionally nearly identical to that of FIG. 4. The threshold pressure is set by the biasing force of the spring 128 against the poppet head 124. Until the line pressure exceeds this threshold pressure, the unrestricted orifice remains closed, while the restricted orifice provided by the notch 122 is open. When the line pressure exceeds the biasing force of the spring, the poppet head 124 is lifted from the valve seat 126 to open the unrestricted orifice, thereby increasing the effective area of the nozzle outlet, in the manner previously described in connection with the nozzle of FIG. 4. In the nozzle of FIG. 5, however, the secondary outlet port 114 provides an even larger outlet area, thereby allowing a greater flow capacity for more effective purging.

Figure 8:
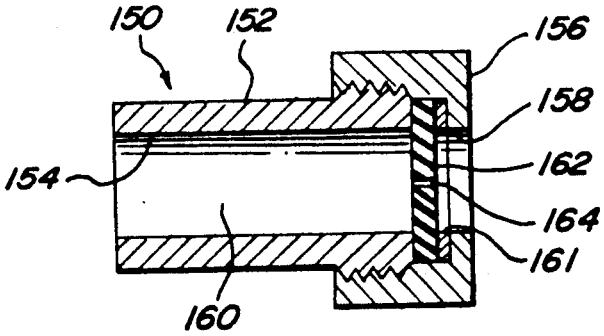
FIG. 8 is an axial cross-sectional view of an additional embodiment of the invention, showing the nozzle in its normal, spraying mode.
Figure 9:
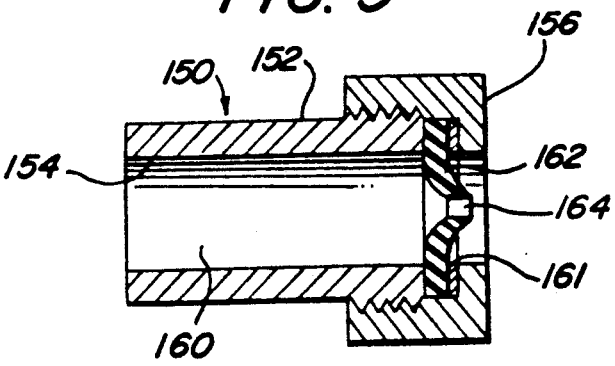
FIG. 9 is a view similar to that of FIG. 8, but showing the nozzle in its purge mode.

FIGS. 8 and 9 illustrate a nozzle 150 in accordance with an alternative embodiment of the invention. The nozzle 150 comprises a hollow tubular body 152 with an open end forming an inlet 154. The other end of the body 152 is externally-threaded. Threaded onto the threaded end of the body is an internally-threaded annular retaining member 156, having a central opening forming an outlet 158. The interior of the body 152 defines a flow passage 160 from the inlet 154 to the outlet 158.

Seated against the threaded end of the body 152 and retained thereon by the retaining member 156 and an annular washer 161 is an occluder disc 162, made from a resilient, elastomeric material. The occluder disc 162 has a central orifice 164 that is relatively small in diameter when the occluder disc 162 is in a relaxed state, as shown in FIG. 8. As the line pressure of the fluid in the passage 160 increases, however, the resilient occluder disc 162 is flexed axially, in the downstream direction. This flexing results in an increase in the diameter of the orifice 164, as shown in FIG. 9.

The material and the thickness of the occluder disc can be selected to provide an increase in effective outlet area when the line pressure exceeds any preselected threshold pressure. Thus, in a specific example, a synthetic rubber occluder disc of 0.035 inches in thickness was used, with an orifice diameter, in the normal spray operating state, of approximately 0.020 inches. At line pressures greater than about 10 psi, significant enlargement of the orifice occurred, with the diameter of the orifice increasing as the line pressure was increased. Thus, with this specific example, normal operation would be with line pressures of approximately 10 psi, resulting in a directed stream of fluid emerging from the orifice and the outlet of the nozzle. Purging of the nozzle would be performed by increasing the line pressure above 10 psi (i.e., to about 40 to 60 psi), resulting in a purging flow through the enlarged orifice.

Although several specific embodiments have been shown and described herein, it will be appreciated that a number of modifications and variations will suggest themselves to those skilled in the pertinent arts. Such variations and modifications should be considered within the spirit and scope of the invention, as defined in the claims that follow.

What is claimed is:

1. A spray nozzle for continuously feeding a solution of soap in water under low pressure to lubricate a conveyor, comprising:

a.) an elongate fitting defining a hollow passage for the flow of the solution, the fitting having inlet and outlet ends for the soap solution, the inlet end being fed by the soap solution, and the outlet end defining a valve seat and a wedge-shaped gap formed thereon, the fitting being outwardly tapered at the outlet end, and peripherally thereof to deflect a flow of soap solution, and thereby produce a spray;

b.) a poppet valve comprising a threaded valve stem and a rotatably adjustable poppet head, the valve stem being disposed centrally and axially within the hollow passage of the fitting, and the poppet head being seatable on the valve seat and adjacent the wedge-shaped gap;

c.) a coil spring surrounding the valve stem within the fitting and adapted for upward biasing against the poppet head to close the poppet head against the valve seat;

d.) a threaded retainer mounted on the valve stem for biasing the spring against the poppet head when the poppet head is adjusted, the poppet head being unseatable by pressure of the soap solution; and, e.) a conveyor associated with a plurality of the spray nozzles, the conveyor being adapted to move food containers and packages thereon;

whereby:

i. outward or inward rotational adjustment of the poppet head through the threaded retainer will adjust compression by the spring against the poppet head onto the valve seat and against the pressure of the soap solution, to control the outlet flow from the wedge-shaped gap, thereby changing spray volume and correspondingly changing the volume of a continuous stream of the soap solution applied to the conveyor when the poppet head is unseated by the pressure of the incoming soap solution;

ii. the poppet valve can be cleaned by increasing the soap solution pressure to unseat the poppet head, or by retracting the poppet head away from the outlet of the fitting against the force of the spring bias, thereby cleaning the nozzle outlet, without interrupting the feed of soap solution to the conveyor;

iii. after the nozzle has been cleaned, the poppet valve is released to reseat on the nozzle outlet; and, iv. the conveyor is adapted to maintain movement during periods of nozzle outlet cleaning, with reduced contamination by microorganisms.

2. The spray nozzle of claim 1, which includes washer means mounted against and under the poppet head, and sealing the nozzle against leakage when the poppet head is seated on the valve seat.

3. The spray nozzle of claim 1, defining an outer, shaped periphery for engagement by a wrench means.

4. The spray nozzle of claim 1, in which the threaded retainer at its outer periphery forms a loose sliding fit with the hollow passage of the fitting, thereby maintaining the valve stem aligned centrally and axially within the hollow passage of the fitting.

5. The spray nozzle of claim 1, in which the poppet head is shaped for engagement with a tool to retract the poppet head away from the outlet of the fitting, thereby enabling the fitting to be cleaned.

6. The spray nozzle of claim 1, in which the spring biasing is adjustable to line pressures of from 10 psi to 70 psi.

7. The spray nozzle of claim 1, in which the spring biasing is adjustable to line pressures of 10 psi at 0.014 gallons per minute to 40 psi at 0.048 gallons per minute.

8. A method for continuously feeding through a spray nozzle a solution of soap solution in water under low pressure to lubricate a conveyor, the spray nozzle comprising:

a.) an elongate fitting defining a hollow passage for the flow of the solution, the fitting having inlet and outlet ends for the soap solution, the inlet end being fed by the soap solution, and the outlet end defining a valve seat and a wedge-shaped gap formed thereon, the fitting being outwardly tapered at the outlet end, and peripherally thereof to deflect a flow of soap solution, and thereby produce a spray;

b.) a poppet valve comprising a threaded valve stem and a rotatably adjustable poppet head, the valve stem being disposed centrally and axially within the hollow passage of fitting, and the poppet head being seatable on the valve seat and adjacent the wedge shaped gap;

c.) a coil spring surrounding the valve stem within the fitting and adapted for upward biasing against the poppet head to close the poppet head against the value seat;

d.) a threaded retainer mounted on the valve seat for biasing the spring against the poppet head when the poppet head is adjusted, the poppet head being unseatable by pressure of the soap solution; and e.) a conveyor associated with the spray nozzle, the conveyor being adapted to move food containers an packages thereon; the process comprising:

i. outwardly or inwardly rotationally adjusting the poppet head through the threaded retainer to adjust compression by the spring against the poppet head onto the valve seat and against the pressure of the soap solution, to control the outlet flow from the wedge-shaped gap, thereby changing spray volume and correspondingly changing the volume of a continuous stream of the soap solution applied to the conveyor when the poppet head is unseated by the pressure of the incoming soap solution;

ii. cleaning the poppet valve by increasing the soap solution pressure to unseat the poppet head, or by retracting the poppet head away from the outlet of the fitting against the force of the spring bias, thereby cleaning the nozzle outlet, without interrupting the feed of soap solution to the conveyor;

iii. after the nozzle has been cleaned, releasing the poppet valve to reseat on the nozzle outlet; and, iv. the conveyor being adapted to maintain movement during periods of nozzle outlet cleaning, with reduced contamination by microorganisms.

9. The method of claim 8, in which the spring biasing is adjustable to line pressures of from about 10 psi–70 psi.

10. The method of claim 8, in which the spring biasing is adjustable to line pressures of from about 10 psi at 0.014 gallons per minute to about 40 psi at 0.048 gallons per minute.

* * * * *